US012098900B2

(12) United States Patent
Turlakov

(10) Patent No.: US 12,098,900 B2
(45) Date of Patent: Sep. 24, 2024

(54) TURLAKOV'S RIFLE N 8 (IRINA)

(71) Applicant: Maxim Turlakov, Ferlach (AT)

(72) Inventor: Maxim Turlakov, Ferlach (AT)

(73) Assignee: Maxim Turlakov, Ferlach (AT)

( * ) Notice: Subject to any disclaimer, the term of this patent is extended or adjusted under 35 U.S.C. 154(b) by 0 days.

(21) Appl. No.: 17/792,765

(22) PCT Filed: Jan. 12, 2021

(86) PCT No.: PCT/RU2021/000008
§ 371 (c)(1),
(2) Date: Jul. 14, 2022

(87) PCT Pub. No.: WO2021/150143
PCT Pub. Date: Jul. 29, 2021

(65) Prior Publication Data

US 2023/0062560 A1 Mar. 2, 2023

(30) Foreign Application Priority Data

Jan. 23, 2020 (RU) ..... RU2020102726

(51) Int. Cl.
*F41A 9/65* (2006.01)
*F41A 3/66* (2006.01)
*F41C 7/00* (2006.01)

(52) U.S. Cl.
CPC ..... *F41A 9/65* (2013.01); *F41A 3/66* (2013.01); *F41C 7/00* (2013.01)

(58) Field of Classification Search
CPC ..... F41C 7/00; F41A 3/66; F41A 9/24; F41A 9/25; F41A 9/41; F41A 9/65
See application file for complete search history.

(56) References Cited

U.S. PATENT DOCUMENTS

| | | | | | |
|---|---|---|---|---|---|
| 396,835 | A * | 1/1889 | Russell | F41A 17/38 | 42/18 |
| 501,367 | A * | 7/1893 | Russell | F41A 17/38 | 42/18 |
| 1,376,694 | A * | 5/1921 | Hines | F41A 9/41 | 89/184 |
| 2,638,694 | A * | 5/1953 | Morris | F41A 3/10 | 42/24 |
| 2,908,987 | A * | 10/1959 | Allyn | F41A 9/65 | 124/52 |
| 3,276,323 | A * | 10/1966 | Dieckmann | F41A 9/41 | D22/104 |
| 8,720,094 | B2 * | 5/2014 | McPherson | B25F 5/02 | 42/71.01 |
| 2011/0088539 | A1 * | 4/2011 | Oz | F41A 19/34 | 42/106 |

* cited by examiner

*Primary Examiner* — Gabriel J. Klein

(57) ABSTRACT

The invention relates to firearms (mainly sports and hunting) and is a magazine-fed firearm in which the magazine is located behind the trigger and at the angle to the vertical plane. This solution allows to reduce the length of the firearm, while not complicating the process of installing the magazine.

2 Claims, 6 Drawing Sheets

TURLAKOV'S RIFLE N 8 (IRINA)

TECHNICAL FIELD

The invention relates to the field of firearms technology and can be used in magazine-fed firearms, mainly in sports and hunting.

BACKGROUND OF THE INVENTION

Known technical solutions when, in order to reduce the length of the firearm, the magazine with cartridges, is located above the trigger, for example U.S. Pat. No. 3,509,654A, EP 218028381, U.S. Pat. No. 7,963,062B1. These solutions are complex and do not provide ease of use.

Known solution, DE 4317310(A1). This design has the magazine protruding to the side, which dramatically worsens the ergonomics of the firearm.

DISCLOSURE OF THE INVENTION

The present invention solves the problem of reducing the length of the firearm and ensuring ease of handling. To achieve this technical result, the firearm has the detachable magazine, which is located behind the trigger, eccentrically and at the angle relative to the longitudinal vertical plane passing through the longitudinal axis of the barrel. In this case, the magazine's receptacle does not protrude beyond the transverse dimensions of the receiver.

BRIEF DESCRIPTION OF DRAWINGS

The essence of the invention is illustrated by drawings, where.

THE BEST EMBODIMENT OF THE INVENTION

Figure 1:
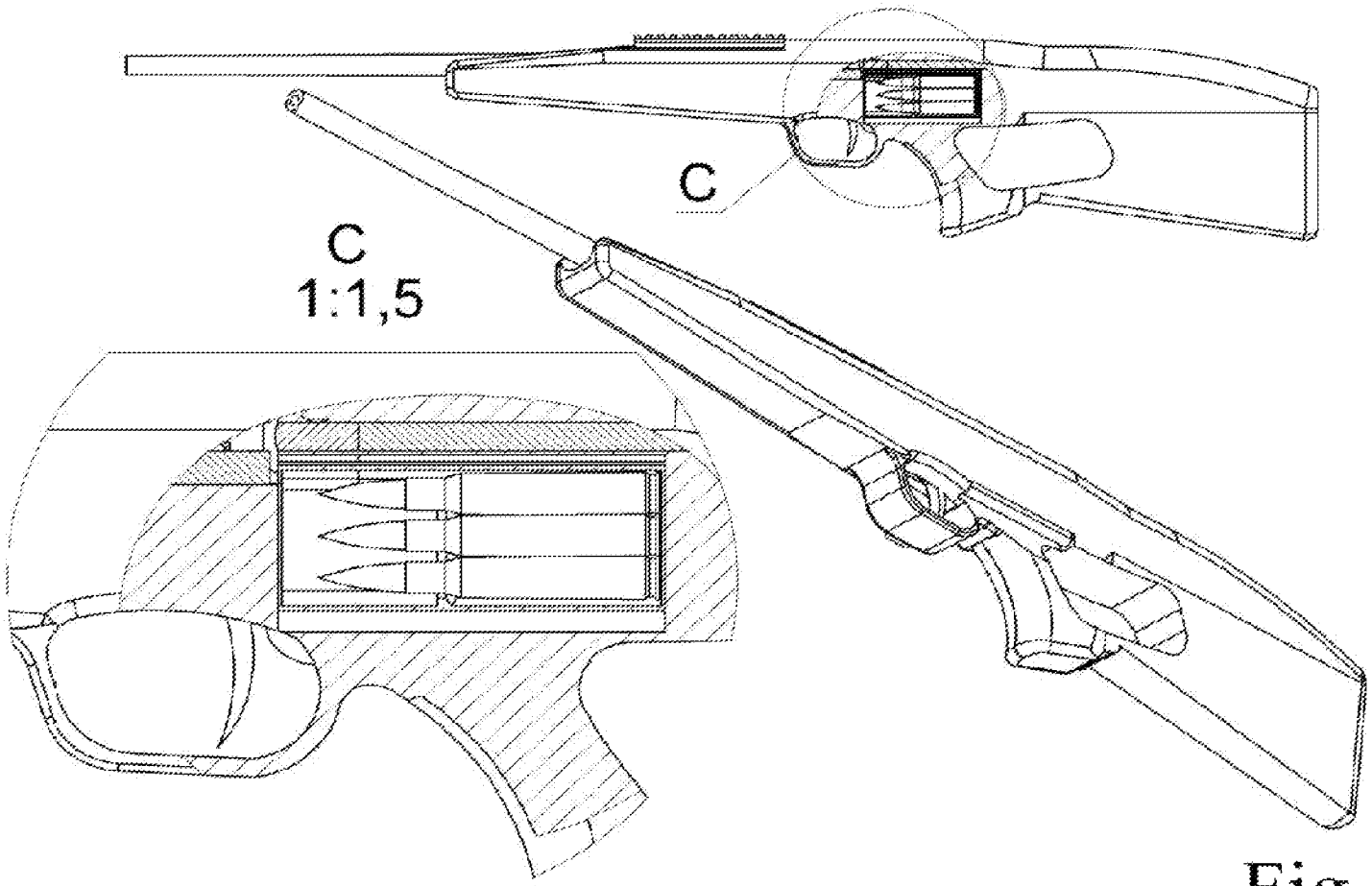
in FIG. 1—the appearance of the proposed firearm, the local view C.

The firearm (FIG. 1, FIG. 2, FIG. 3) contains the barrel 1, the bolt 2 with the handle 2.1, the receiver 3 with the receptacle of the magazine 3.2, the trigger 3.3, the magazine 4 with cartridges 5.

Figure 2:
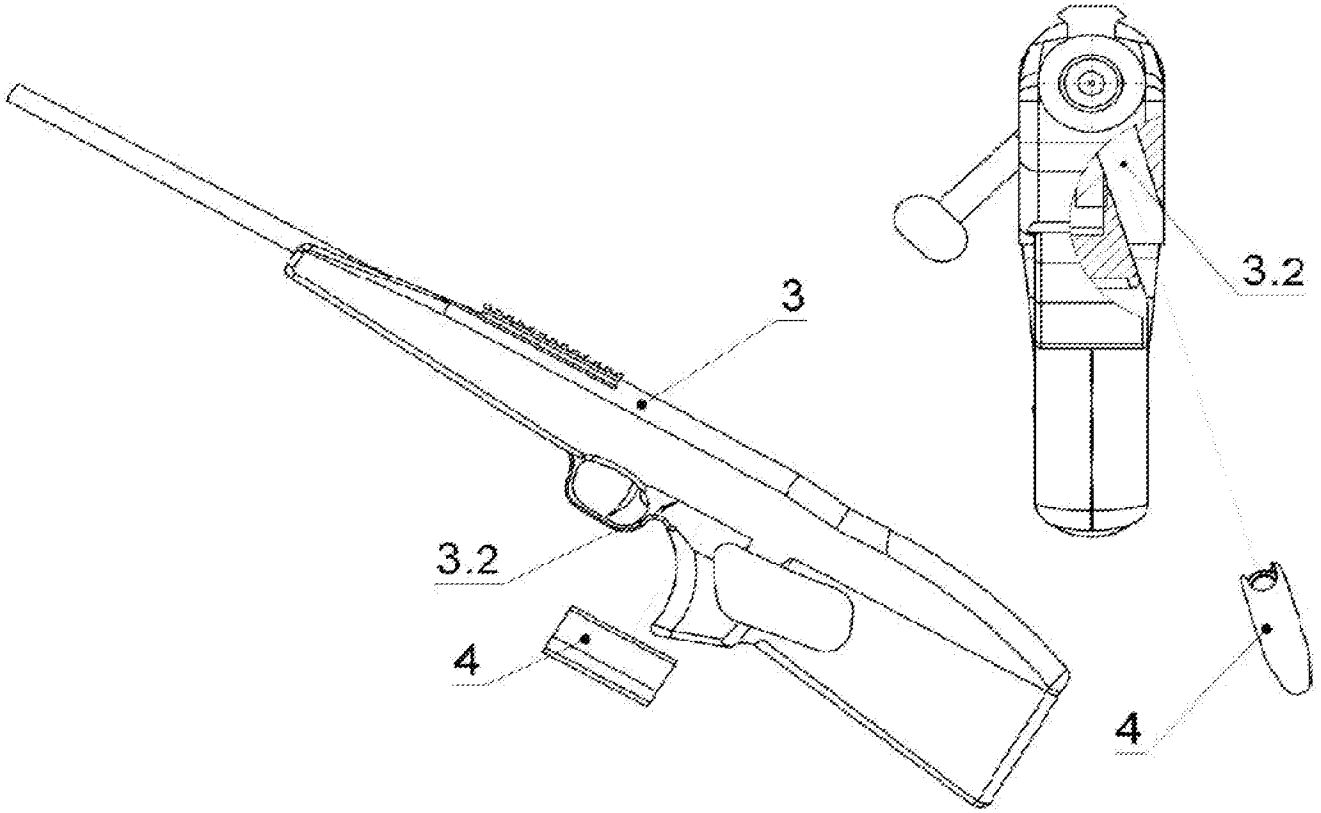
in FIG. 2—the diagram for installing the magazine in the firearm.

The magazine 4 placed in the receptacle of the magazine 3.2 according to the diagram in FIG. 2.

Figure 3:
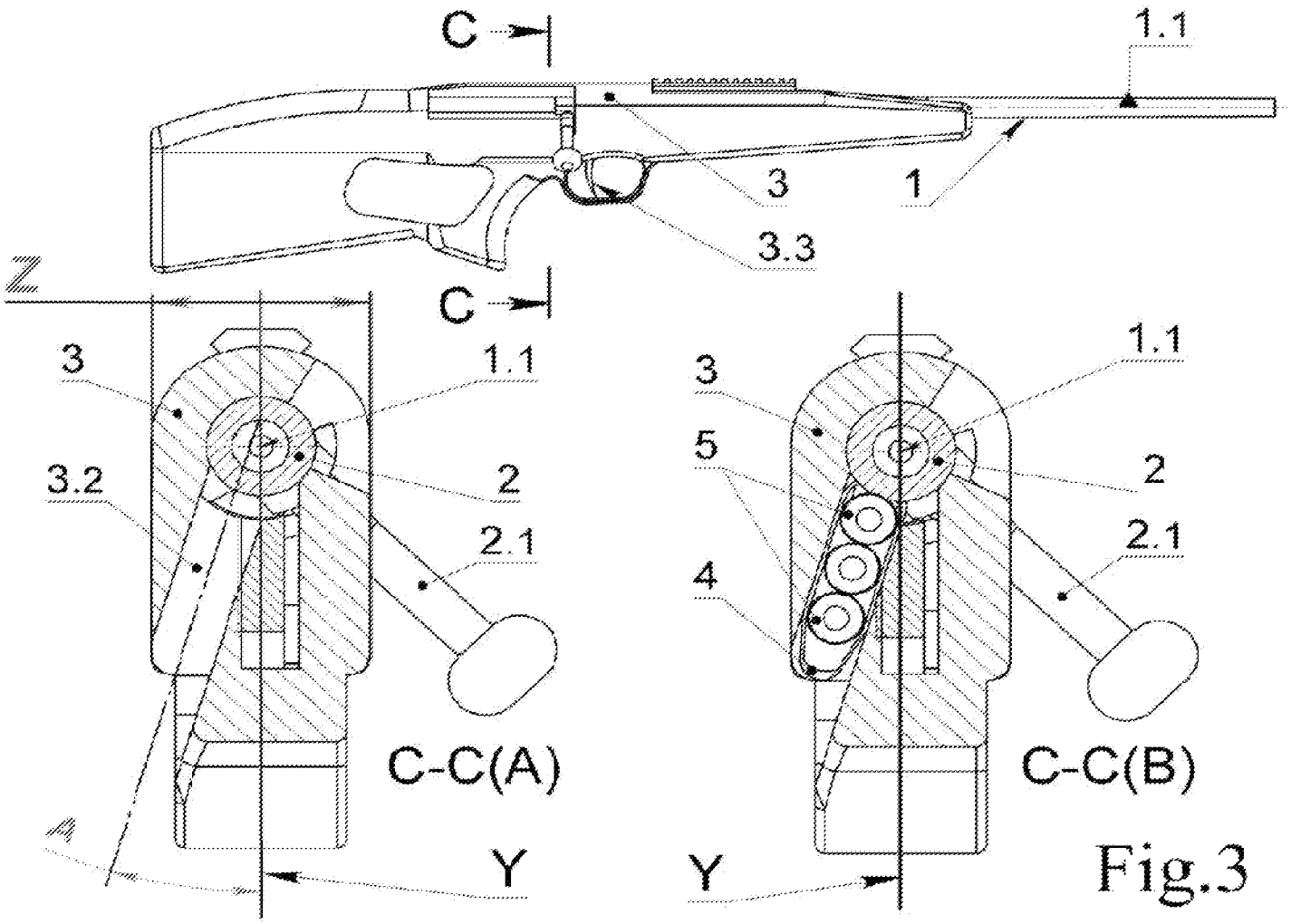
in FIG. 3—the appearance of the proposed firearm sections C-C(A), C-C(B)

The receptacle 3.2 (FIG. 3, section C-C(A)), is at the angle "A" and eccentric relative to the vertical plane passing through the longitudinal axis of the barrel 1.1. At the same time, the receptacle of the magazine 3.2 does not protrude beyond the transverse dimensions Z of the receiver 3.

Figure 4:
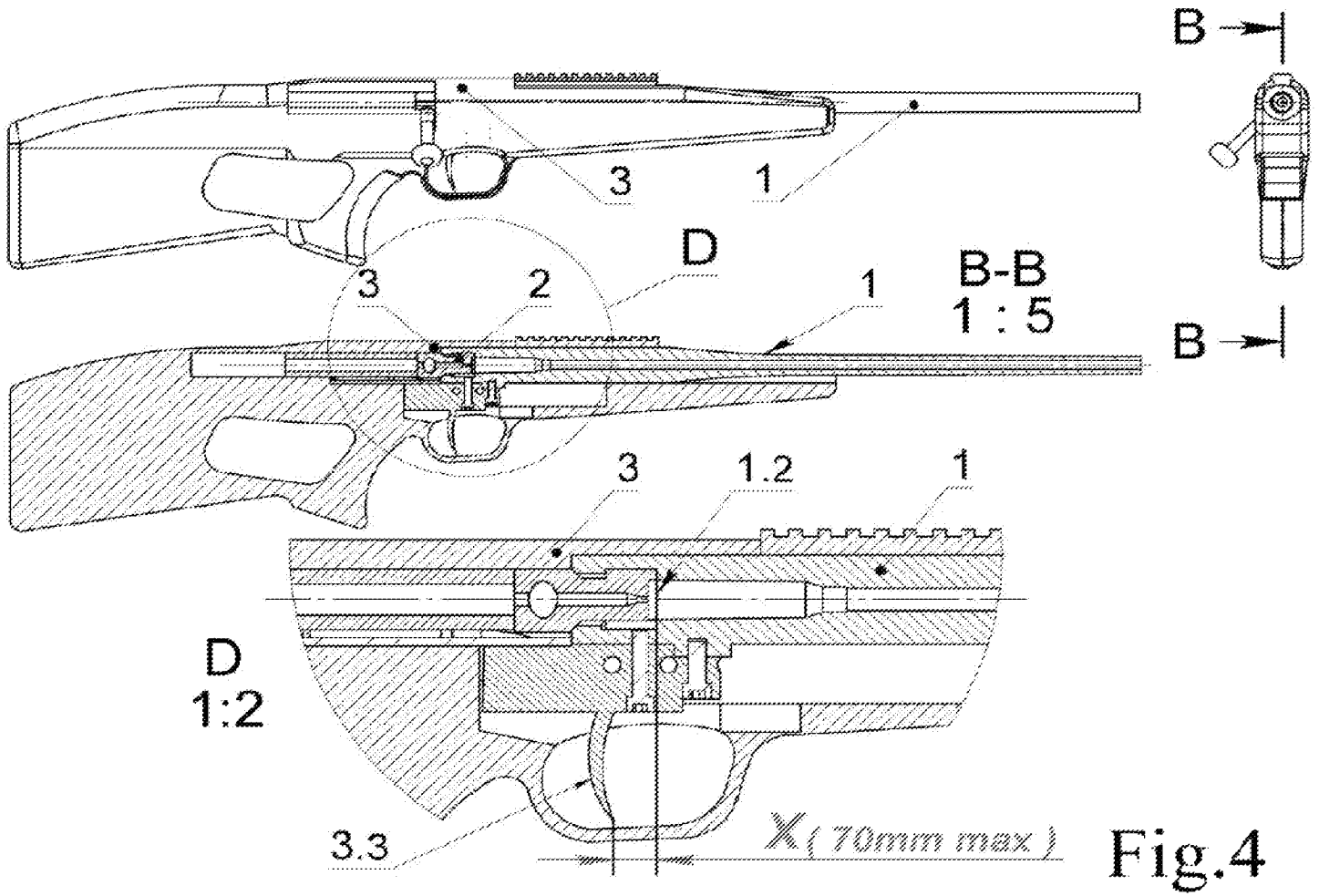
in FIG. 4—the appearance of the proposed firearm, section B-B, the local, view D, showing the distance from the breech end of the barrel to the trigger.

In FIG. 4 shows the removal of the breech end of the barrel 1.2 from the trigger 3.3, which in this variant of the firearm is no more than 70 millimeters.

Figure 5:
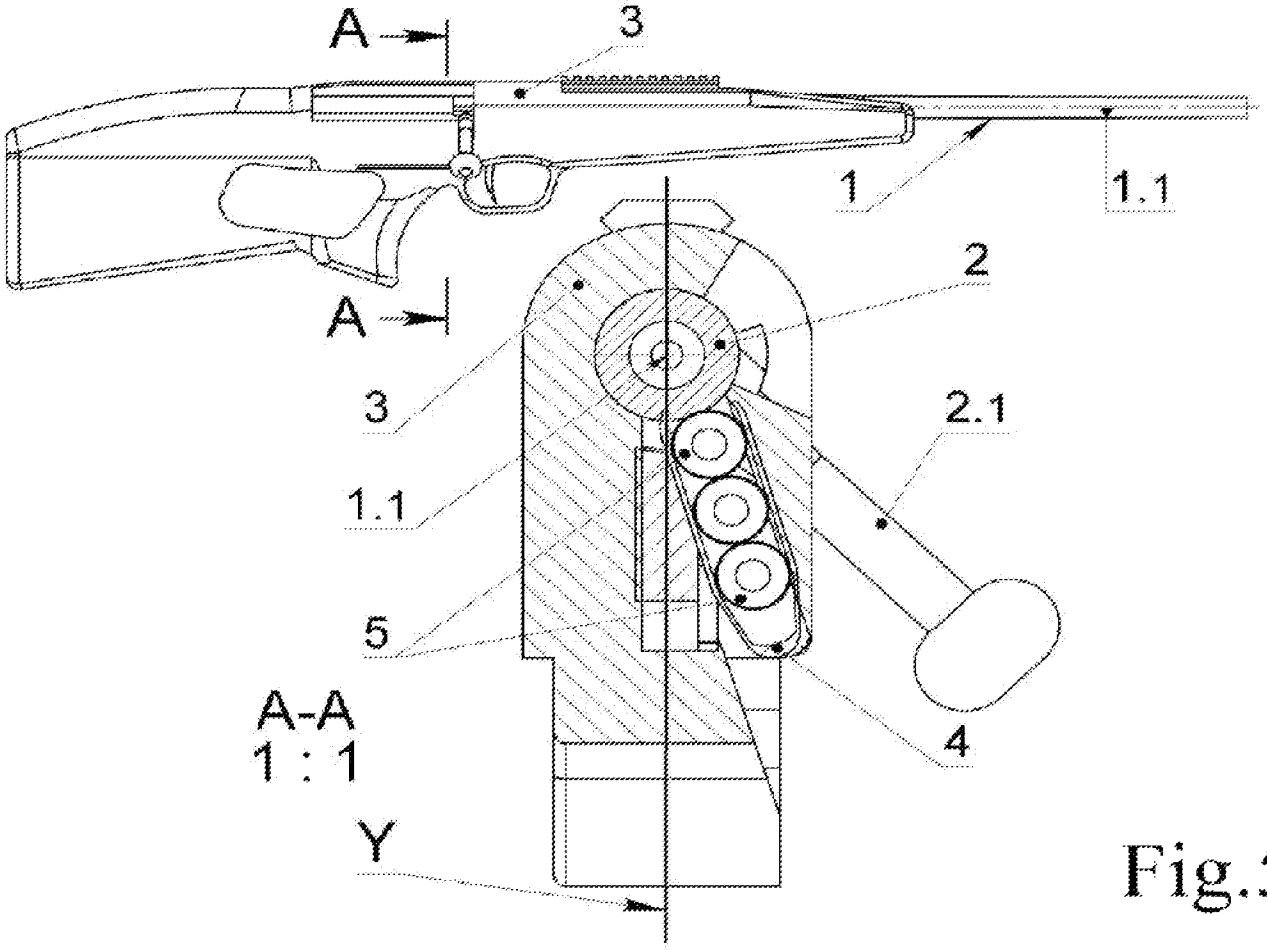
in FIG. 5—the appearance of the proposed firearm in the variant when the magazine is located in the same vertical half-plane with the bolt handle, section A-A.

In FIG. 5 the variant when the magazine 4 is located in the same vertical half-plane with the handle 2.1 of the bolt 2.

Figure 6:
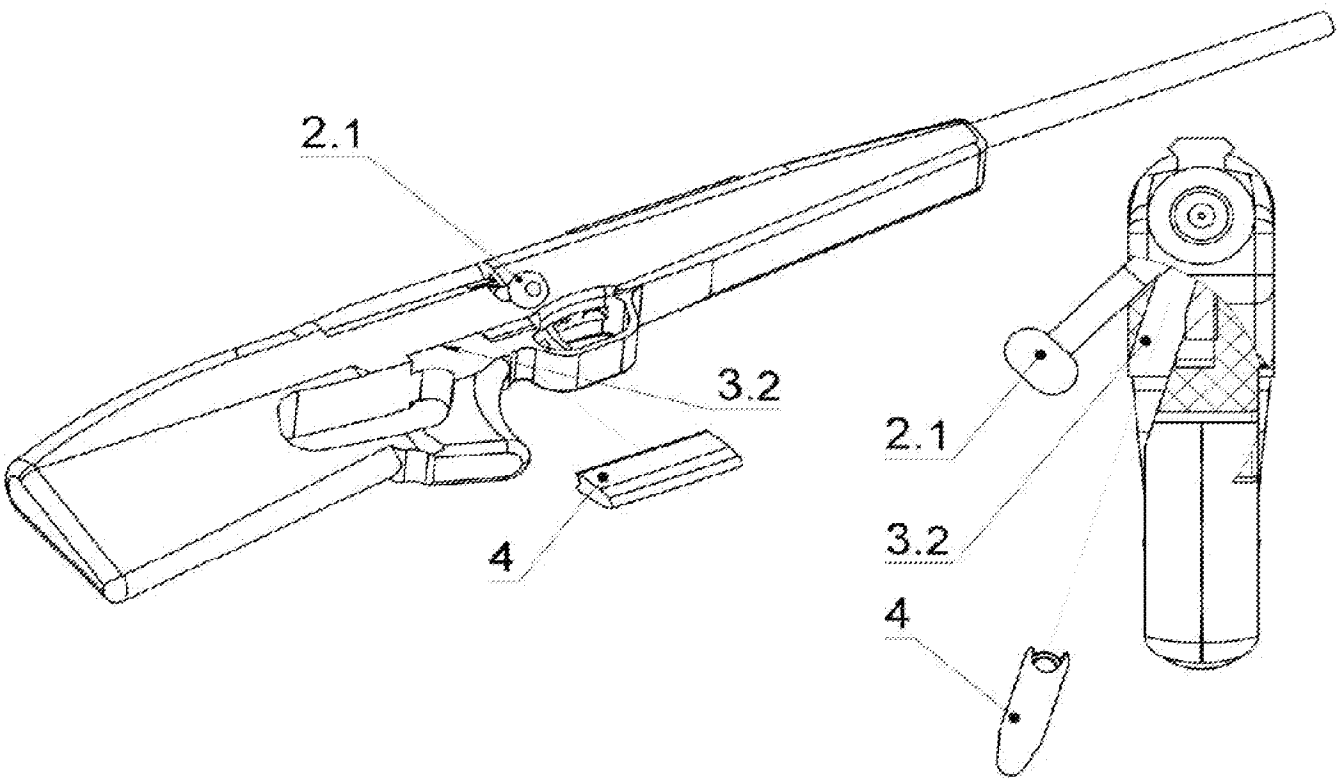
in FIG. 6—the diagram of installing the magazine in the firearm, when the magazine is located in the same vertical half-plane with the bolt handle.

In FIG. 6 is the diagram of the installation of the magazine 4, in the variant when the receptacle of the magazine 3.2 and the bolt handle 2.1 are located in the same vertical half-plane.

The invention claimed is:

1. A firearm comprising a barrel having a horizontal longitudinal axis and a breech end, a bolt with a handle, a receiver with a horizontal transverse axis and a receptacle for a magazine, a trigger extending vertically downward from the receiver, and a detachable magazine, wherein the receptacle is located in the receiver and includes a longitudinal axis passing through an open end of the receptacle and arranged eccentrically and at an acute angle relative to a vertical longitudinal plane that passes through the longitudinal axis of the barrel and the trigger, wherein the detachable magazine does not protrude beyond transverse dimensions of the receiver when fully installed in the receptacle in a position to feed cartridges to the breech end, and wherein a distance from the trigger to the breech end is no more than 70 millimeters.

2. The firearm of claim 1, wherein the magazine and the handle are located in a same vertical half-plane.

* * * * *